US009005379B2

(12) United States Patent
Chesini

(10) Patent No.: US 9,005,379 B2
(45) Date of Patent: Apr. 14, 2015

(54) PROCESS FOR OBTAINING A PIPE FOR SUPPLYING FUEL TO AN INTERNAL COMBUSTION ENGINE

(75) Inventor: Natale Chesini, Verona (IT)

(73) Assignee: Chesini Meccanica S.R.L. (IT)

( * ) Notice: Subject to any disclaimer, the term of this patent is extended or adjusted under 35 U.S.C. 154(b) by 686 days.

(21) Appl. No.: 12/481,685

(22) Filed: Jun. 10, 2009

(65) Prior Publication Data

US 2009/0308502 A1 Dec. 17, 2009

(30) Foreign Application Priority Data

Jun. 11, 2008 (IT) ..... VR2008A0068

(51) Int. Cl.

| | |
|---|---|
| ***C21D 9/08*** | (2006.01) |
| ***C21D 8/02*** | (2006.01) |
| ***C21D 1/00*** | (2006.01) |
| ***C21D 9/00*** | (2006.01) |
| ***B21K 1/16*** | (2006.01) |
| ***B21K 21/12*** | (2006.01) |
| ***F02M 55/00*** | (2006.01) |
| ***F02M 55/02*** | (2006.01) |

(52) U.S. Cl.

CPC . *B21K 1/16* (2013.01); *B21K 21/12* (2013.01); *F02M 55/005* (2013.01); *F02M 55/02* (2013.01)

(58) Field of Classification Search

None

See application file for complete search history.

(56) References Cited

U.S. PATENT DOCUMENTS

| | | | | |
|---|---|---|---|---|
| 2,232,657 | A * | 2/1941 | Davis | 285/226 |
| 4,168,190 | A * | 9/1979 | Eguchi et al. | 148/568 |
| 5,109,888 | A * | 5/1992 | Usui | 138/109 |
| 6,070,618 | A | 6/2000 | Iwabuchi | |
| 7,025,838 | B2 * | 4/2006 | Yazawa et al. | 148/610 |
| 2003/0044637 | A1 * | 3/2003 | Hasegawa et al. | 428/679 |

FOREIGN PATENT DOCUMENTS

| | | | | |
|---|---|---|---|---|
| EP | 1 995 445 | | 11/2008 | |
| SU | 1655628 | * | 6/1991 | B21D 19/00 |
| WO | WO 2007/105659 | | 9/2007 | |
| WO | WO 2007/105660 | | 9/2007 | |

OTHER PUBLICATIONS

Lampman ed., 241-268 ASM Handbook vol. 14A (2005).*

European Search Report issued on Oct. 19, 2009 in corresponding European Patent Application No. 09162461.9 (5 pages).

* cited by examiner

*Primary Examiner* — Yoshitoshi Takeuchi

(74) *Attorney, Agent, or Firm* — Ostrolenk Faber LLP

(57) ABSTRACT

The present invention relates to a process for producing a pipe, particularly for supplying fuel to an engine, comprising the steps of:

prearranging a pipe made of stainless steel (1), executing a hot-pressing operation at at least one end (3) of the pipe (1); and subjecting the at least one end (3) of the pipe (1) to heat treatment, followed by cooling.

5 Claims, 1 Drawing Sheet

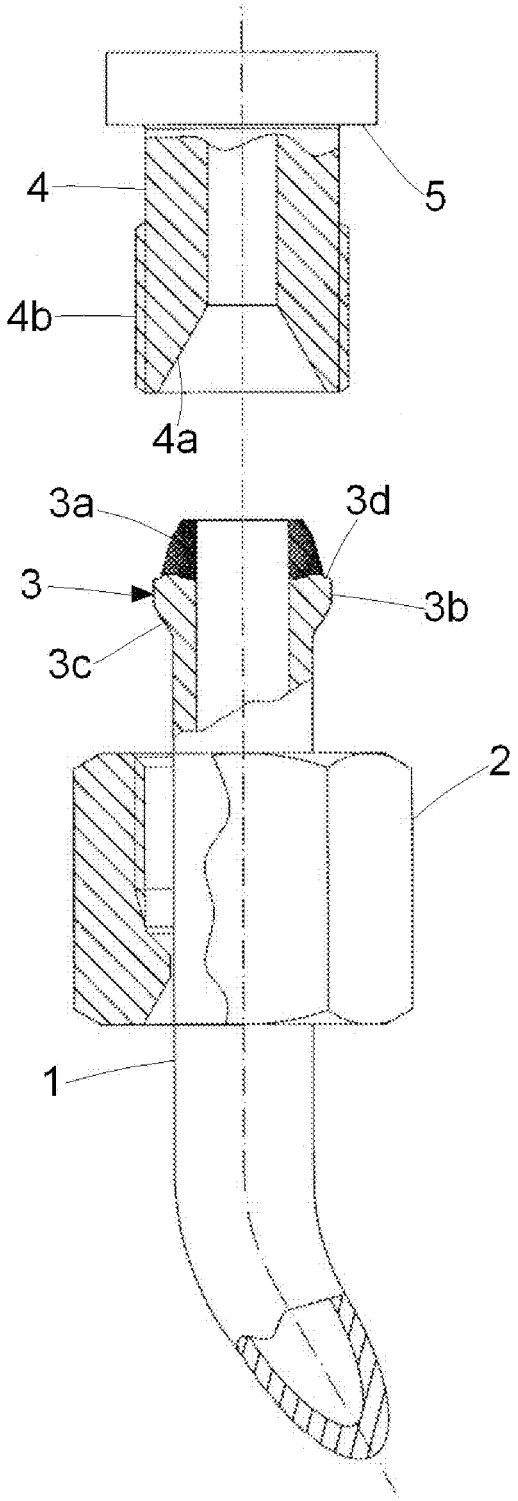
4
5
4b
4a
3a
3d
3
3b
3c
2
1

PROCESS FOR OBTAINING A PIPE FOR SUPPLYING FUEL TO AN INTERNAL COMBUSTION ENGINE

FIELD OF INVENTION

The present invention relates to a process for obtaining a fuel supply pipe made of stainless steel, in particular for fuel injection to internal combustion engines, as well as a process for obtaining the same.

BACKGROUND OF INVENTION

The pipes for injecting gasoline into engines are normally made of stainless steel, preferably austenitic steel, which in addition to having good mechanical properties also has optimal resistance to corrosion caused by the gasoline. Stainless steel pipes or tubes have already been proposed; at whose ends a respective enlarged or pointed oval head is welded which has maximum diameter greater than the outer diameter of the pipe. The head is intended to abut against a receiving seat, in use, e.g. formed in a mouth or relief in an injector body or in a pump body or "fuel rail".

As is known, when a liquid or fluid flows through a pipe, it is affected by electric charges due to the so-called "triboelectric" effect. In such a manner, galvanic currents are generated in the pipe that in the long run can compromise effectiveness of the welding, with consequent fuel leaks, injection pressure lowering and engine performance drop.

Moreover, during manufacture it is necessary to carry out two welds, operations which require the use of sophisticated and costly equipment as well as personnel with a high level of training.

SUMMARY OF THE INVENTION

The main object of the present invention is that of providing a process for producing a stainless steel pipe for supplying fuel to an injection engine which is safe and relatively easy and quick to obtain.

Another object of the present invention is that of providing a stainless steel pipe for supplying fuel to an injection engine that is fully reliable over time and particularly resistant to galvanic currents.

Another object of the present invention is that of providing a stainless steel pipe for supplying fuel to an injection engine which has a competitive production cost.

These and still other objects, which will be clearer below, are achieved by a process for producing a pipe for supplying fuel to an engine comprising the steps of prearranging a stainless steel pipe, carrying out a hot-pressing operation at at least one end of the pipe, and subjecting said at least one end of the pipe to heat treatment followed by cooling.

Advantageously, a pipe obtained according to the above-mentioned process is characterized in that the at least one end thereof subjected to hot-pressing sequentially has a frustoconical end section, a substantially cylindrical intermediate section with outer diameter greater than the frustoconical end section, and a frustoconical section for connection to the pipe.

BRIEF DESCRIPTION OF THE SOLE FIGURE

Further aspects and advantages of the present invention will be clearer from the detailed description of a currently preferred embodiment thereof, illustrated as merely a non-limiting example in the attached drawing, in which the single FIGURE shows a view with parts removed of a pipe according to the present invention and an engagement component for such pipe.

DETAILED DESCRIPTION OF THE PREFERRED EMBODIMENT

With reference to the drawing, a pipe 1 is illustrated that is designed to supply fluid or gaseous fuel to an injection engine, in particular a gasoline injection engine. The pipe 1 is preferably made of austenitic stainless steel and has one end 3 thereof configured as an attachment head with a substantially frustoconical (preferably pointed) end section 3*a*, followed by a substantially cylindrical intermediate section 3*b* with outer diameter greater than the adjacent frustoconical section 3*a*, and an internal frustoconical section 3*c* for connection to the remaining part of the pipe and having decreasing cross section towards the remaining portion of the pipe 1. Due to the slight increase, between the frustoconical terminal section 3*a* and the cylindrical portion 3*b*, an annular shoulder 3*d* is preferably delimited.

The end configured as an attachment head 3 is obtained via hot-pressing, an operation which causes a hardening of the head itself and in particular of its pointed section 3*a*. For the purpose of softening and thus reducing the risk of breakage, the molded attachment head is subjected to heat treatment, i.e. it is heated via induction, after which it is allowed to cool or fast cooling thereof is caused in air or inert atmosphere.

The heat treatment provides for heating so as to bring the carbides contained in the stainless steel, in particular in the austenitic stainless steel, in solution; it also allows a partial recrystallization of the microstructure or "grain" of the steel. In such a manner, a reduction of the hardness is caused, at least of the end section 3*a*, from about 350° to 200-190° Vickers. Preferably, heating is carried out at a temperature in the range of about 800° C. to about 1300° C.

If desired, both ends (the end 3 and the other end not shown in the drawings) of the pipe 1 are heat treated by induction after the hot-pressing step, as indicated above.

A pipe 1 according to the present invention can be e.g. installed on, and fixed to a frustoconical, hollow appendage or relief 4, which delimits a frustoconical reception seat 4*a* in fluid communication with an injector body 5 or a pump body or "fuel rail" for an injection engine, in particular a gasoline injection engine. The hollow appendage or relief 4, known as the "connection interface", is externally threaded at 4*b* for the removable fixing of a tightening connector or nut 2 thereon; by acting on the internal frustoconical section 3*c* of the attachment head 3, such connector or nut 2 being suitable for tightening the frustoconical end section 3*a* against the frustoconical receiving seat 4*a* in the hollow relief 4.

It will be understood that a pipe according to the present invention is easily obtainable, with uniform composition and free of welding spots or lines, and thus resistant to galvanic currents. It is therefore not liable to suffer corrosion attack nor give rise to fluid or gaseous fuel leakage.

After hot-pressing, the steel of the pipe 1 becomes at least partly work-hardened and thus is very hard, so that it would not be suitable for ensuring a secure fluid seal between the frustoconical end section 3*a* and the receiving seat 4*a*, also made of stainless steel. Moreover, the rubbing of these components could in the long run compromise the integrity of the relatively softer seat 4*a* of the section 3*a*. Due to the induction heating, a softening is caused that is suitable for bringing its hardness level back to the initial level (before the hot-pressing operation)—at least at the frustoconical end section 3*a*, for its optimal arrangement in the receiving seat 4*a*. The latter occurs without the risk of scraping the seat, which would compromise its seal at work pressures, usually on the order of about 0-3000 bar.

The pipe described above is susceptible to numerous modifications and variations within the scope of protection defined by the claims.

The invention claimed is:

1. A process for producing a pipe comprising a first end configured to be installed on a seat connected to an injector pump, the pipe configured to supply fuel to an engine, the method comprising the steps of:

prearranging a pipe made of stainless steel, wherein the stainless steel comprises carbides, and the pipe is free of welding spots and welding lines;

subsequent to prearranging the pipe, hot-pressing the first end or at both ends of the pipe, wherein each end of said pipe subjected to the hot-pressing has a frustoconical end section, a cylindrical intermediate section with outer diameter greater than said frustoconical end section, and another frustoconical section connecting said cylindrical intermediate section to the remainder of the non-hot pressed pipe;

subsequent to the hot-pressing of the pipe, subjecting said first end or both ends of said pipe to a heat induction treatment, wherein the carbides contained in the stainless steel are solutionized into solution during said heat induction treatment; and subsequent to the heat induction treatment, cooling said pipe, wherein the heat induction treatment is performed such that the frustoconical end portion is softened, returning the frustoconical end portion to the hardness prior to the hot pressing operation.

2. A process as claimed in claim 1, wherein said first end or both ends are heated to a temperature in the range of about 800° C. to about 1300° C.

3. A process as claimed in claim 1, wherein said pipe is made of austenitic stainless steel.

4. A process as claimed in claim 1, wherein a shoulder is positioned between said first frustoconical end section and said cylindrical intermediate portion, the shoulder extending continuously between said first frustoconical end section and said cylindrical intermediate portion.

5. The process as claimed in claim 1, wherein the heat induction treatment is performed by induction heating the first end of the pipe.

* * * * *